US005310165A

United States Patent [19]

Benz et al.

[11] Patent Number: 5,310,165

[45] Date of Patent: * May 10, 1994

[54] ATOMIZATION OF ELECTROSLAG REFINED METAL

[75] Inventors: Mark G. Benz, Burnt Hills; Thomas F. Sawyer, Stillwater; Steven A. Miller, Amsterdam, all of N.Y.

[73] Assignee: General Electric Company, Schenectady, N.Y.

[ * ] Notice: The portion of the term of this patent subsequent to Nov. 3, 2009 has been disclaimed.

[21] Appl. No.: 969,906

[22] Filed: Nov. 2, 1992

[51] Int. Cl.[5] ..... B22F 9/08

[52] U.S. Cl. ..... 266/201; 266/202; 222/603

[58] Field of Search ..... 266/201, 202; 222/594, 222/603

[56] References Cited

U.S. PATENT DOCUMENTS

| | | | |
|---|---|---|---|
| 3,817,503 | 6/1974 | Lafferty et al. | 425/7 |
| 3,826,301 | 7/1974 | Brooks | 164/46 |
| 3,909,921 | 10/1975 | Brooks | 29/527.2 |
| 3,988,084 | 10/1976 | Esposito et al. | 425/7 |
| 4,575,325 | 3/1986 | Duerig et al. | 425/7 |
| 4,619,597 | 10/1986 | Miller | 425/7 |
| 4,619,845 | 10/1986 | Ayers et al. | 427/422 |
| 4,631,013 | 12/1986 | Miller | 425/7 |
| 4,779,802 | 10/1988 | Coombs | 239/292 |
| 4,801,412 | 1/1989 | Miller | 264/12 |
| 4,926,923 | 5/1990 | Brooks et al. | 164/5 |
| 5,004,153 | 4/1991 | Sawyer | 239/81 |
| 5,084,091 | 1/1992 | Yolton | 75/336 |
| 5,160,532 | 11/1992 | Benz et al. | 266/202 |

OTHER PUBLICATIONS

D. J. Chronister, S. W. Scott, D. R. Stickle, D. Eylon, F. H. Froes, "Induction of Skull Melting of Titanium and Other Reactive Alloys," Journal of Metals, Sep. 1986, pp. 51-54.

Alan Lawley, "Atomization of Specialty Alloy Powders," Journal of Metals, Jan. 1981, pp. 13-18.

*Primary Examiner*—George Wyszomierski

*Attorney, Agent, or Firm*—James Magee, Jr.

[57] ABSTRACT

A method of atomization of refined metal is taught. The method starts with the introduction of unrefined metal into an electroslag refining process in which the unrefined metal is first melted at the upper surface of the refining slag. The molten metal in the form of droplets is refined as it passes through the molten slag. The refined metal droplets are collected in a cold hearth apparatus having a skull of refined metal formed on the surface of the cold hearth and protecting the cold hearth from the leaching action of the refined molten metal. A cold finger bottom pour spout is formed at the bottom of the cold hearth to permit dispensing of molten refined metal from the cold hearth. The rate of flow of molten metal through the cold finger apparatus is controlled principally by controlling the rate of melting of the unrefined metal. The metal flowing from the cold finger apparatus is introduced to the upper end of a ceramic melt guide tube. Liquid metal emerging from the lower end of the melt guide tube is atomized by a gas orifice closely coupled to the lower end of the melt guide tube.

1 Claim, 3 Drawing Sheets

ATOMIZATION OF ELECTROSLAG REFINED METAL

CROSS-REFERENCE TO RELATED APPLICATIONS

The present invention relates closely to commonly owned applications as follows:

Ser. No. 07/779,773, filed Oct. 21, 1991, now U.S. Pat. No. 5,160,532;
Ser. No. 07/920,075, filed Jul. 27, 1992;
Ser. No. 07/920,066, filed Jul. 27, 1992;
Ser. No. 07/928,581, filed Aug. 13, 1992;
Ser. No. 07/920,078, filed Jul. 27, 1992, now abandoned;
Ser. No. 07/928,596, filed Aug. 13, 1992;
Ser. No. 07/898,609, filed Jun. 15, 1992;
Ser. No. 07/898,602, filed Jun. 15, 1992; and
Ser. No. 07/928,385, filed Aug. 12, 1992.

BACKGROUND OF THE INVENTION

The present invention relates generally to closely coupled gas atomization. More particularly, it relates to methods and means by which closely coupled gas atomization processing of high melting reactive molten metal can be started and carried out with electroslag refined metal.

The technology of close coupled or closely coupled atomization is a relatively new technology. Methods and apparatus for the practice of close coupled atomization are set forth in commonly owned U.S. Pat. Nos. 4,631,013; 4,801,412; and 4,619,597, the texts of which are incorporated herein by reference. As pointed out in these patents, the idea of close coupling is to create a close spatial relationship between a point at which a melt stream emerges from a melt orifice into an atomization zone and a point at which a gas stream emerges from a gas orifice to impact the melt stream as it emerges from the melt orifice into the atomization zone. Close coupled atomization is accordingly distinguished from the more familiar and conventional remotely coupled atomization by the larger spatial separation between the respective nozzles and point of impact in the remotely coupled apparatus. A number of independently owned prior art patents deal with close proximity of melt and gas streams and include U.S. Pat. Nos. 3,817,503; 4,619,845; 3,988,084; and 4,575,325.

In the more conventional remotely coupled atomization, a stream of melt may be in free fall through several inches before it is impacted by a gas stream directed at the melt from an orifice which is also spaced several inches away from the point of impact.

The remotely coupled apparatus is also characterized by a larger spatial separation of a melt orifice from a gas orifice of the atomization apparatus. Most of the prior art of the atomization technology concerns remotely coupled apparatus and practices. One reason for this is that attempts to operate closely coupled atomization apparatus resulted in many failures due to the many problems which are encountered. This is particularly true for efforts to atomize reactive metals which melt at relatively high temperatures of over 1000° C. or more. The technology disclosed by the above referenced commonly owned patents is, in fact, one of the first successful closely coupled atomization practices that has been developed.

The problem of closely coupled atomization of highly reactive high temperature (above 1,000° C.) metals is entirely different from the problems of closely coupled atomization of low melting metals such as lead, zinc, or aluminum. The difference is mainly in the degree of reactivity of high reacting alloys with the materials of the atomization apparatus.

One of the features of the closely coupled atomization technology, particularly as applied to high melting alloys such as iron, cobalt, and nickel base superalloys is that such alloys benefit from having a number of the additive elements in solid solution in the alloy rather than precipitated out in the alloy and the closely coupled atomization can result in a larger fraction of additive elements remaining in solid solution. For example, if a strengthening component such as titanium, tantalum, aluminum, or niobium imparts desirable sets of properties to an alloy, this result is achieved largely from the portion of the strengthening additive which remains in solution in the alloy in the solid state. In other words, it is desirable to have certain additive elements such as strengthening elements remain in solid solution in the alloy rather than in precipitated form. Closely coupled atomization is more effective than remotely coupled atomization in producing the small powder sizes which will retain the additive elements in solid solution.

Where still higher concentrations of additive elements are employed above the solubility limits of the additives, the closely coupled atomization technology can result in nucleation of precipitates incorporating such additives. However, because of the limited time for growth of such nucleated precipitates, the precipitate remains small in size and finely dispersed. It is well-known in the metallurgical arts that finely dispersed precipitates are advantageous in that they impart advantageous property improvements to their host alloy when compared, for example, to coarse precipitates which are formed during slow cooling of large particles. Thus, the atomization of such a superalloy can cause a higher concentration of additive elements, such as strengthening elements, to remain in solution, or precipitate as very fine precipitate particles, because of the very rapid solidification of the melt in the closely coupled atomization process. This is particularly true for the finer particles of the powder formed from the atomization.

In this regard, it is known that the rate of cooling of a molten particle of relatively small size in a convective environment such as a flowing fluid or body of fluid material is determined by the properties of the droplet and of the cooling fluid. For a given atomization environment, that is one in which the gas, alloy, and operating conditions are fixed, the complex function relating all the properties can be reduced to the simple proportionality involving particle size shown below, $$T_p \alpha \frac{1}{D_p^2}$$

where:

$T_p$=cooling rate, and $D_p$=droplet diameter.

Simply put, the cooling rate for a hot droplet in a fixed atomization environment is inversely proportional to the diameter squared. Accordingly, the most important way to increase the cooling rate of liquid droplets is to decrease the size of the droplets. This is the function of effective gas atomization.

Thus it follows that if the average size of the diameter of a droplet of a composition is reduced in half, then the rate of cooling is increased by a factor of about 4. If the average diameter is reduced in half again, the overall cooling rate is increased 16 fold.

Since high cooling rates are predominantly produced by reducing droplet size, it is critical to effectively atomize the melt.

The Weber number, We, is the term assigned to the relationship governing droplet breakup in a high velocity gas stream. The Weber number may be calculated from the following expression:

$$We = \frac{\rho V^2 D}{\sigma}$$

where $\rho$ and V are the gas density and velocity, and $\sigma$ and D are the droplet surface tension and diameter.

When the We number exceeds ten, the melt is unstable and will breakup into smaller droplets. The dominant term in this expression is gas velocity and thus in any atomization process it is essential to have high gas velocities. As described in the commonly owned U.S. Pat. No. 4,631,013 the benefit of close coupling is that it maximizes the available gas velocity in the region where the melt stream is atomized. In other words, the close coupling is itself beneficial to effective atomization because there is essentially no loss of gas velocity before the gas stream from the nozzle impacts the melt stream and starts to atomize it.

Because of this relationship of the particle size to the cooling rate, the best chance of keeping a higher concentration of additive elements of an alloy, such as the strengthening additives, in solid solution in the alloy is to atomize the alloy to very small particles. Also, the microstructure of such finer particles is different from that of larger particles and often preferable to that of larger particles.

For an atomization processing apparatus, accordingly the higher the percentage of the finer particles which are produced the better the properties of the articles formed from such powder by conventional powder metallurgical techniques. For these reasons, there is strong economic incentive to produce finer particles through atomization processing.

As pointed out in the commonly owned prior art patents above, the closely coupled atomization technique results in the production of powders from metals having high melting points with higher concentration of fine powder. For example, it was pointed out therein that by the remotely coupled technology only 3% of powder produced industrially is smaller than 10 microns and the cost of such powder is accordingly very high. Fine powders of less than 37 microns in diameter of certain metals are used in low pressure plasma spray applications. In preparing such powders by remotely coupled techniques, as much as 60–75% of the powder must be scrapped because it is oversized. This need to selectively separate out only the finer powder and to scrap the oversized powder increases the cost of useable powder.

Further, the production of fine powder is influenced by the surface tension of the melt from which the fine powder is produced. For melts of high surface tension, production of fine powder is more difficult and consumes more gas and energy. The remotely coupled industrial processes for atomizing such powder have yields of less than 37 microns average diameter from molten metals having high surface tensions of the order of 25 weight % to 40 weight %. A major cost component of fine powders prepared by atomization and useful in industrial applications is the cost of the gas used in the atomization. Using remotely coupled technology, the cost of the gas increases as the percentage of fine powder sought from an atomized processing is increased. Also, as finer and finer powders are sought, the quantity of gas per unit of mass of powder produced by conventional remotely coupled processing increases. The gas consumed in producing powder, particularly the inert gas such as argon, is expensive.

As is explained more fully in the commonly owned patents referred to above, the use of the closely coupled atomization technology of those patents results in the formation of higher concentrations of finer particles than are available through the use of remotely coupled atomization techniques. The texts of the commonly owned patents are incorporated herein by reference.

As is pointed out more fully in the commonly owned U.S. Pat. No. 4,631,013, a number of different methods have been employed in attempts to produce fine powder. These methods have included rotating electrode process, vacuum atomization, rapid solidification rate process and other methods. The various methods of atomizing liquid melts and the effectiveness of the methods is discussed in a review article by A. Lawly, entitled "Atomization of Specialty Alloy Powders", which article appeared in the Jan. 19, 1981 issue of the Journal of Metals. It was made evident from this article and has been evident from other sources that gas atomization of molten metals produces the finest powder on an industrial scale and at the lowest cost.

It is further pointed out in the commonly owned U.S. Pat. No. 4,631,013 patent that the close coupled processing as described in the commonly owned patents produces finer powder by gas atomization than prior art remotely coupled processing.

A critical factor in the close coupled gas atomization processing of molten metals is the melting temperature of the molten metal to be processed. Metals which can be melted at temperatures of less than 1000° C. are easier to atomize than metals which melt at 1500° or 2000° C. or higher, largely because of the degree of reactivity of the metal with the atomizing apparatus at the higher temperatures. The nature of the problems associated with close coupled atomization is described in a book entitled "The Production of Metal Powders by Atomization", authored by John Keith Beddow, and printed by Haden Publishers, as is discussed more fully in the the commonly owned U.S. Pat. No. 4,631,013.

The problems of attack of liquid metals on the atomizing apparatus is particularly acute when the more reactive liquid metals or more reactive constituent of higher melting alloys are involved. The more reactive metals include titanium, niobium, aluminum, tantalum, and others. Where such ingredients are present in high melting alloys such as the superalloys, the tendency of these metals to attack the atomizing apparatus itself is substantial. For this reason, it is desirable to atomize a melt at as low a temperature as is feasible.

It has been observed with regard to the prior art structures as discussed above relative to the prior art patents that where the superheat in the melt passing through the melt guide tube is at a sufficiently low level, there is a tendency for the molten metal passing through the melt guide tube to form a solid layer of solidified metal against the inner wall of the melt guide tube and eventually to solidify completely, thus blocking melt guide tube and in effect terminating the atomization procedure.

An important aspect of the atomization of metals which melt at high temperatures is means by which the supply of the molten metal to the atomization processing is accomplished. In general, very high specification metal is desirable as is noted above. In part, the high specification pertains to the absence of particulate ceramic material. In addition, the high specification can pertain to a low level of oxides or other contaminants. Pursuant to the present invention a novel combination of atomization processing is coupled with a unique molten metal supply to make possible a novel and unique atomization processing. In particular, a closely coupled atomization processing is combined with an electroslag refining to permit atomization of uniquely high specification molten metal.

By way of providing further background of this novel overall atomization processing the background of a unique electroslag refining method is now provided.

This aspect of the present invention relates generally to direct processing of metal passing through an electroslag refining operation. More specifically, it relates to processing a stream of metal which stream is generated directly beneath an electroslag processing apparatus.

As explained in U.S. Pat. No. 5,160,532, it is known that the processing relatively large bodies of metal, such as superalloys, is accompanied by many problems which derive from the bulky volume of the body of metal itself. Such processing involves problems of sequential heating and forming and cooling and reheating of the large bodies of the order of 5,000 to 35,000 pounds or more in order to control grain size and other microstructure. Such problems also involve segregation of the ingredients of alloys in large metal bodies as processing by melting and similar operations is carried out. A sequence of processing operations is sometimes selected in order to overcome the difficulties which arise through the use of bulk processing and refining operations.

One such sequence of steps involves a sequence of vacuum induction melting followed by electroslag refining and followed, in turn, by vacuum arc refining and followed, again in turn, by mechanical working through forging and drawing types of operations. While the metal produced by such a sequence of steps is highly useful and the metal product itself is quite valuable, the processing through the several steps is expensive and time-consuming.

For example, the vacuum induction melting of scrap metal into a large body of metal of 20,000 to 35,000 pounds or more can be very useful in recovery of the scrap material. The scrap may be combined with virgin metal to achieve a nominal alloy composition desired and also to render the processing economically sound. The size range is important for scrap remelting economics. According to this process, the scrap and other metal is processed through the vacuum induction melting steps so that a large ingot is formed and this ingot has considerably more value than the scrap and other material used in forming the ingot. Following this conventional processing, the large ingot product is usually found to contain one or more of three types of defects and specifically voids, slag inclusions and macrosegregation.

This recovery of scrap into an ingot is the first step in a refining process which involves several sequential processing steps. Some of these steps are included in the subsequent processing specifically to cure the defects generated during the prior processing. For example, such a large ingot may then be processed through an electroslag refining step to remove a significant portion of the oxide and sulfide which may be present in the ingot as a result of the ingot being formed at least in part from scrap material.

Electroslag refining is a well-known process which has been used industrially for a number of years. Such a process is described, for example, on pages 82–84 of a text on metal processing entitled "Superalloys, Supercomposites, and Superceramics". This book is edited by John K. Tien and Thomas Caulfield and is published by Academic Press, Inc. of Harcourt Brace Jovanovich, and bears the copyright of 1989. The use of this electroslag refining process is responsible for removal of oxide, sulfide and other impurities from the vacuum induction melted ingot so that the product of the processing has lower concentrations of these impurities. The product of the electroslag refining is also largely free of voids and slag inclusions.

However, a problem arises in the electroslag refining process because of the formation of a relatively deep melt pool as the process is carried out. The deep melt pool results in a degree of ingredient macrosegregation and in a less desirable microstructure. Defects produced by macrosegregation are visually apparent and are called "freckles". One way to reduce freckles is by reducing the diameter of the formed ingot but such reduction can also adversely affect economics of the processing.

To overcome this deep melt pool problem, a subsequent processing operation is employed in combination with the electroslag refining, particularly to reduce the depth of the melt pool and the segregation and microstructure problems which result from the deeper pool. This latter processing is a vacuum arc refining and it is also carried out by a conventional and well-known processing technique.

The vacuum arc refining starts with the ingot produced by the electroslag refining and processes the metal through the vacuum arc steps to produce a relatively shallow melt pool and to produce better microstructure, and possibly a lower nitrogen content, as a result. Again, for reasons of economic processing, a relatively large ingot of the order of 10 to 40 tons is processed through the electroslag refining and then through the vacuum arc refining. However, the large ingots of this processing has a large grain size and may contain defects called "dirty" white spots.

Following the vacuum arc refining, the ingot of this processing is then mechanically worked to yield a metal stock which has better microstructure. Such a mechanical working may, for example, involve a combination of steps of forging and drawing to lead to a relatively smaller grain size. The thermomechanical processing of such a large ingot requires a large space on a factory floor and requires large and expensive equipment as well as large and costly energy input.

The conventional processing as described immediately above has been found necessary over a period of time in order to achieve the very desirable microstructure in the metal product of the processing. As is indicated above in describing the background of this art, one of the problems is that one processing step results in some deficiency in the product of that step so that another processing step is combined with the first in order to overcome the deficiency of the initial or earlier step in the processing. However, when the necessary combination of steps is employed, a successful and beneficial product with a desirable microstructure is produced. The drawback of the use of this recited combination of processing steps is that very extensive and expensive equipment is needed in order to carry out the sequence of processing steps and further a great deal of processing time and heating and cooling energy is employed in order to carry out each of the processing steps and to go from one step to the next step of the sequence as set forth above.

The processing as described above has been employed in the application of superalloys such as IN-718 and René 95. For some alloys the sequence of steps has led to successful production of alloy billets, the composition and crystal structure of which are within specifications so that the alloys can be used as produced. For other superalloys, and specifically for the René 95 alloy, it is usual for metal processors to complete the sequence of operations leading to specification material by adding the processing through powder metallurgy techniques. Where such powder metallurgical techniques were employed, the first steps in completing the sequence are the melting of the alloy and gas atomization of the melt. This is followed by screening the powder which is produced by the atomization. The selected fraction of the screened powder is then conventionally enclosed within a can of soft steel, for example, and the can is HIPed to consolidate the powder into a useful form. Such HIPing may be followed by extruding or other conventional processing steps to bring the consolidated product to a useable form.

An alternative to the powder metallurgy processing as described immediately above is an alternative conventional process known as spray forming. Spray forming has been described in a number of patents including the U.S. Pat. Nos. 3,909,921; 3,826,301; 4,926,923; 4,779,802; 5,004,153; as well as a number of other such patents.

In general, the spray forming process has been gaining additional industrial use as improvements have been made in processing, particularly because it involves fewer steps and has a cost advantage over conventional powder metallurgy techniques so there is a tendency toward the use of the spray forming process where it yields products which are comparable and competitive with the products of the conventional powder metallurgy processing.

BRIEF STATEMENT OF THE INVENTION

In one of its broader aspects, objects of the invention can be achieved by providing an ingot having non-specification chemistry and microstructure, introducing the ingot into an electroslag refining vessel containing molten slag to electrically contact the slag in said vessel, passing a high electric current through the ingot and slag to cause the ingot to resistance melt at the surface where it contacts the slag and to cause droplets of ingot formed from such melting to pass down through the slag and to be refined as they pass through the slag, collecting the descending molten metal in a cold hearth positioned beneath the electroslag refining vessel, providing a cold finger bottom pour spout at the bottom of the cold hearth apparatus to permit refined molten to pass through the spout as a stream, disposing a ceramic melt guide tube immediately beneath said spout, closely coupling a gas orifice to the lower end of said melt guide tube, and atomizing the melt emerging from said melt guide tube.

The present invention in another of its broader aspects may be accomplished by an apparatus for producing powder of refined metal alloy which comprises electroslag refining apparatus comprising a metal refining vessel adapted to receive and to hold a metal refining molten slag, means for positioning an electrode in said vessel in touching contact with said molten slag, electric supply means adapted to supply refining current to said electrode and through said molten slag to the metal refining vessel and to keep said refining slag molten, means for advancing said electrode toward said molten slag at a rate corresponding to the rate at which the electrode is consumed as the refining thereof proceeds, a cold hearth beneath said metal refining vessel, said cold hearth being adapted to receive and to hold electroslag refined molten metal in contact with a solid skull of said refined metal in contact with said cold hearth, a cold finger orifice below said cold hearth adapted to receive and to dispense as a stream molten metal processed through said electroslag refining process and through said cold hearth, a ceramic melt guide tube adapted to receive said stream of refined metal at its upper end and to guide said molten metal to its lower end, and means for close coupled atomization disposed at the lower end of said melt guide tube to deliver a stream of closely coupled atomizing gas to a stream of said refined molten metal as it emerges from said melt guide tube, the angle between the gas stream and the melt stream being between 8 and 25 degrees.

BRIEF DESCRIPTION OF THE DRAWINGS

The detailed description of the invention which follows will be understood with greater clarity if reference is made to the accompanying drawings in which:

FIG. 4 is a semischematic illustration in part in section of the cold finger nozzle portion of an apparatus similar to that illustrated in FIG. 3 but showing the apparatus free of molten metal.

FIG. 5 is a graph in which flow rate in pounds per minute is plotted against the area of the nozzle opening in square millimeters for two different heads of molten metal and specifically a lower plot for a head of about 2 inches and an upper plot for a head of about 10 inches of molten metal.

DETAILED DESCRIPTION OF THE INVENTION

Figure 1:
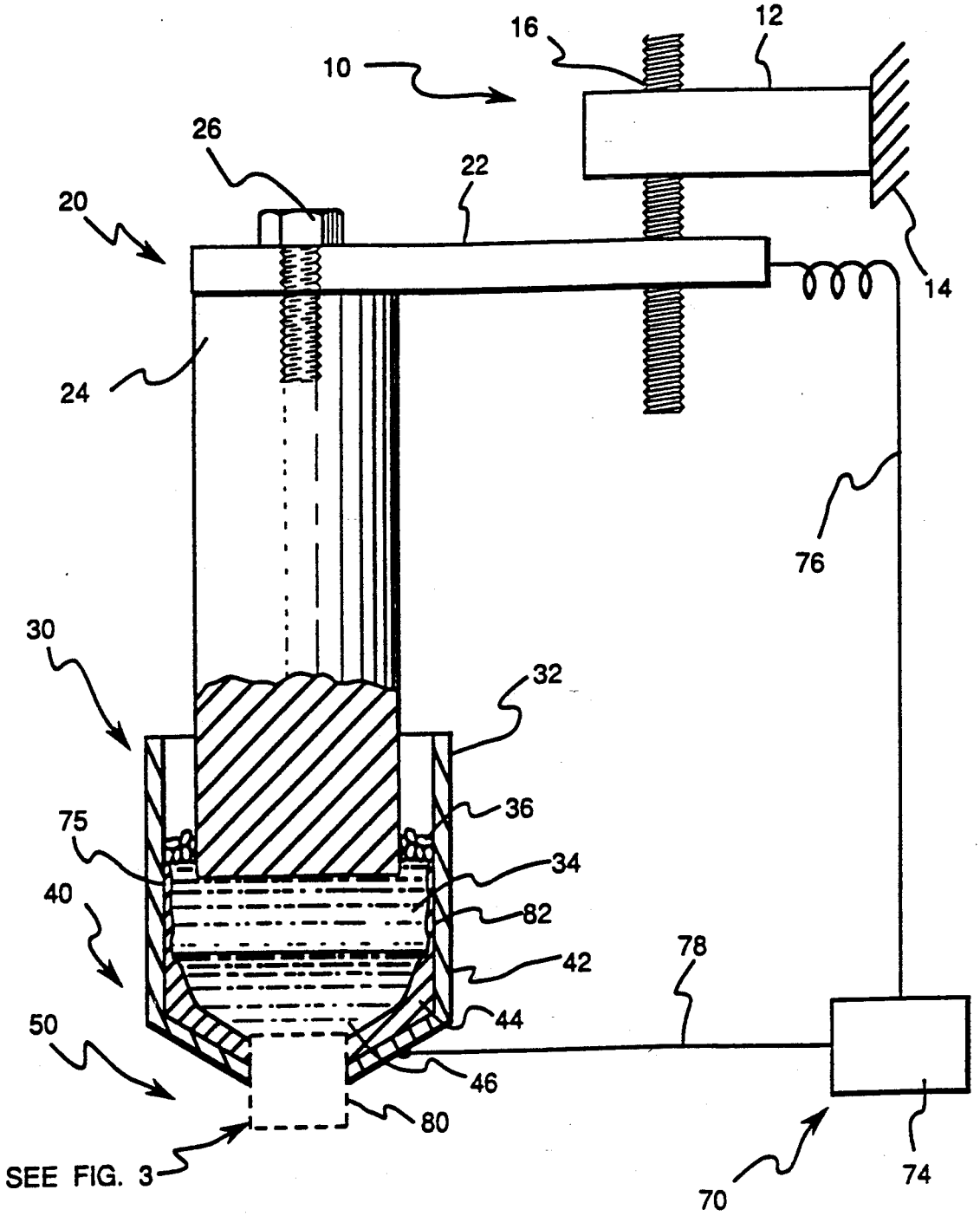
FIG. 1 is a semischematic vertical sectional view of an apparatus suitable for carrying out the refining aspect of the present invention.

The method of the present invention is carried out by introducing an ingot of metal to be refined directly into an electroslag refining apparatus and refining the metal to produce a melt of refined metal which is received and retained within a cold hearth apparatus mounted immediately below the electroslag refining apparatus. The molten metal is dispensed from the cold hearth through a cold finger orifice mounted directly below the cold hearth reservoir. The molten metal then passes to a melt guide tube of a closely coupled atomization apparatus and is atomized to fine particles. Contact between the stream of atomizing gas and the stream of melt occurs at an acute angle of less than 45 degrees.

If the rate of electroslag refining of metal and accordingly the rate of delivery of refined metal to a cold hearth approximates the rate at which molten metal is drained from the cold hearth through the cold finger orifice and delivered to the melt guide tube, an essentially steady state operation is established in the overall apparatus and the process can operate continuously for an extended period of time and, accordingly, can process a large bulk of unrefined metal to refined metal.

As the metal is drained from the cold hearth through the cold finger orifice, it is further processed to produce refined metal powder. A very important aspect of the invention is that it effectively eliminates many of the bulky ingot processing operations such as those described in the background statement above and which, until now, have been necessary in order to produce a metal product having a desired set of properties and microstructure.

Another very important aspect of the invention is that the refined metal is delivered in its purest state directly to the closely coupled atomization apparatus and eliminates any opportunity for the metal to be altered in its composition or to otherwise become contaminated.

The processing described herein is applicable to a wide range of alloys which can be processed beneficially through the electroslag refining processing. Such alloys include nickel- and cobalt-based superalloys, zirconium based alloys, titanium-based alloys, and ferrous-based alloys, among others. The slag used in connection with such metals will vary with the metal being processed and will usually be the slag conventionally used with a particular metal in the conventional electroslag refining thereof.

The several processing techniques may be combined to produce a large body of refined metal powder because the ingot which can be processed through the combined electroslag refining and cold hearth and cold finger and close coupled atomization mechanism can be a relatively large supply ingot and can, accordingly, produce a continuous stream of metal exiting from the cold finger orifice over a prolonged period to deliver a large volume of molten metal to the close coupled atomization apparatus.

An illustrative apparatus is described below with particular reference to the processing through a close coupled atomization operation although it will be understood that the combination of electroslag refining taken together with the cold hearth retention and the cold finger draining of the cold hearth is a novel apparatus and process by itself as explained more, fully in U.S. Pat. No. 5,160,532.

Figure 2:
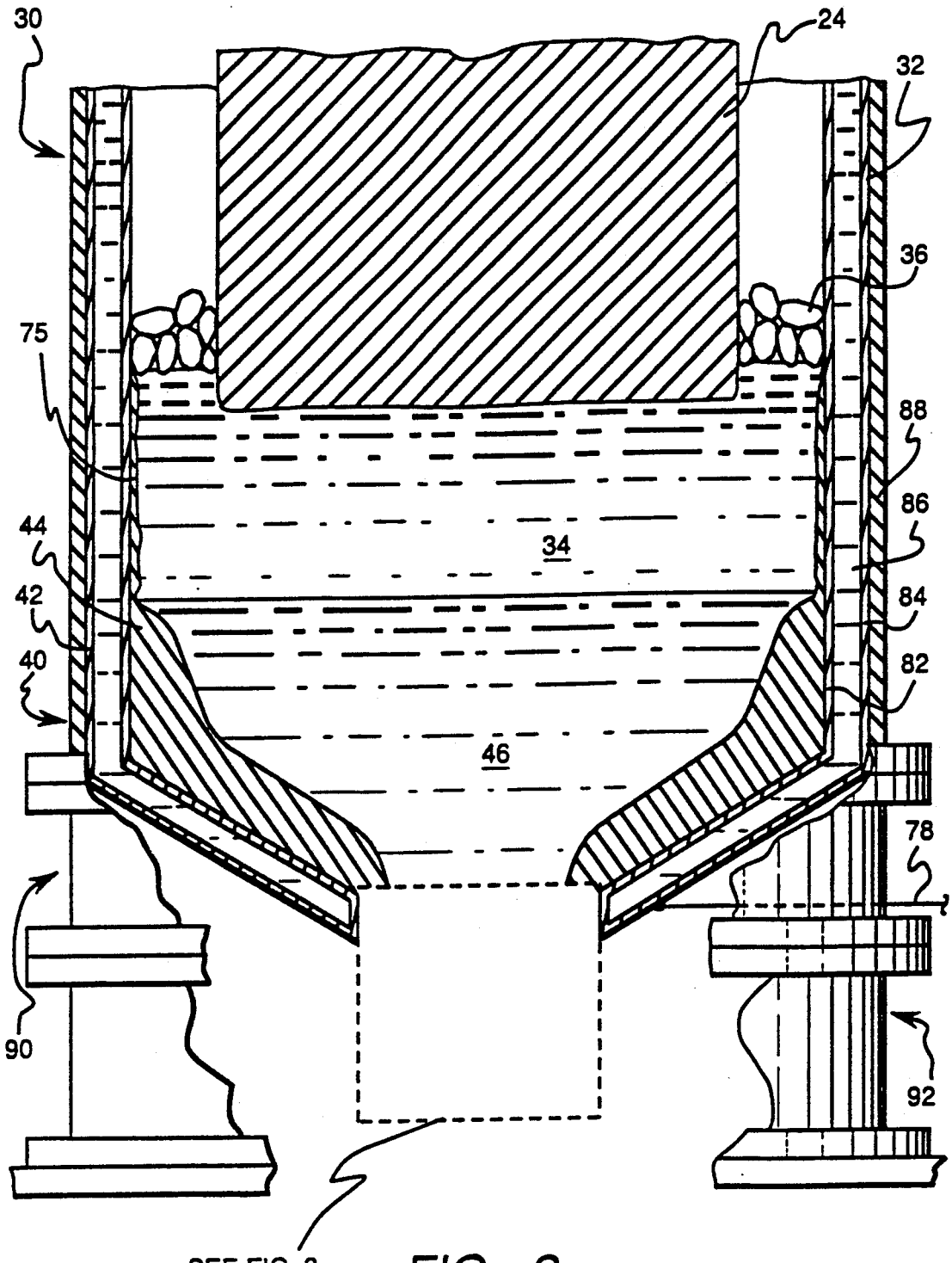
FIG. 2 is a semischematic vertical sectional illustration of an apparatus such as that illustrated in FIG. 1 but showing more structural detail regarding the refining aspect than is presented in FIG. 1.

Referring now particularly to the accompanying drawings, FIGS. 1 and 2 are semischematic elevational views, in part in section, of a number of the essential and auxiliary elements of apparatus for carrying out the electroslag refining aspect of the present invention. Referring now, first, to FIGS. 1 and 2, there are a number of processing stations and mechanisms and these are described starting at the top.

A vertical motion control apparatus 10 is shown schematically. It includes a box 12 mounted to a vertical support 14 and containing a motor or other mechanism adapted to impart rotary motion to the screw member 16. An ingot support station 20 comprises a bar 22 threadedly engaged at one end to the screw member 16 and supporting the ingot 24 at the other end by conventional bolt means 26.

An electroslag refining station 30 comprises a water cooled reservoir 32 containing a molten slag 34 an excess of which is illustrated as the solid slag granules 36. A skull of slag 75 may form along the inside surfaces of the inner wall 82 of vessel 32 due to the cooling influence of the cooling water flowing against the outside of inner wall 82.

A cold hearth station 40 is mounted immediately below the electroslag refining station 30 and it includes a water cooled hearth 42 containing a skull 44 of solidified refined metal and also a body 46 of liquid refined metal. Water cooled reservoir 32 may be formed integrally with water cooled hearth.

Figure 3:
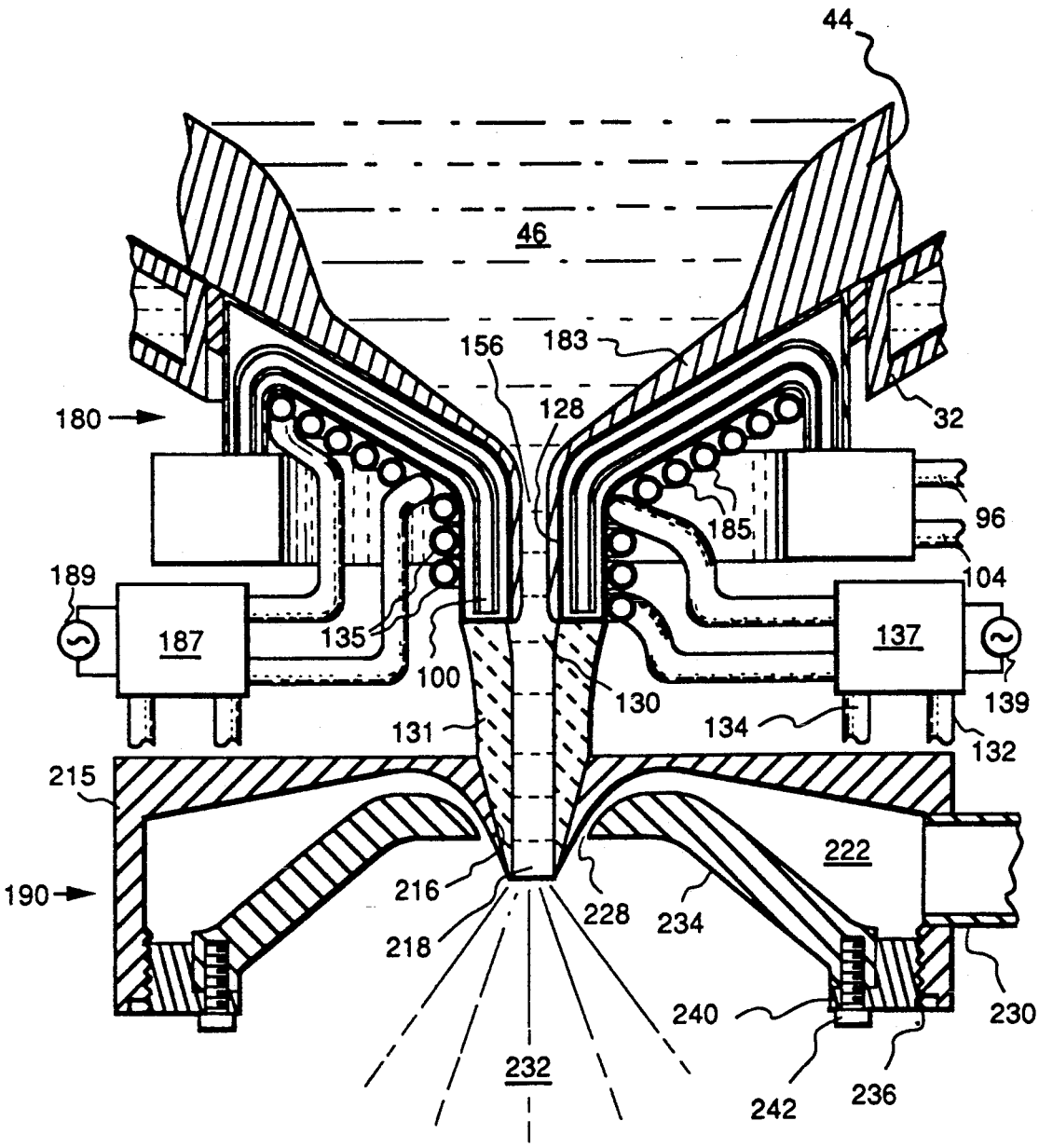
FIG. 3 is a semischematic vertical section in greater detail of the cold finger nozzle and close coupled atomization nozzle portions of the structures of FIG. 1 and FIG. 2.

The bottom dispense and atomize structure (shown as an empty dashed box) 80 of the apparatus is provided in the form of a cold finger orifice which is described more fully with reference to FIGS. 3. An atomization station 190 is provided in box 80 immediately below the cold hearth dispensing station 180 and cold finger orifice.

Electric refining current is supplied by station 70. The station includes the electric power supply and control mechanism 74. It also includes the conductor 76 carrying current to the bar 22 and, in turn, to ingot 24. Conductor 78 carries current to the metal vessel wall 32 to complete the circuit of the electroslag refining mechanism.

Referring now more specifically to FIG. 2, this figure is a more detailed view of stations 30, and 40 of FIG. 1. In general, the reference numerals as used in FIG. 2 correspond to the reference numerals as used in FIG. 1 so that like parts bearing the same reference numeral in each figure have essentially the same construction and function.

Similarly, the same reference numerals are used with respect to the same parts in the still more detailed view of FIGS. 3 and 4 discussed more thoroughly below.

As indicated above, FIG. 2 illustrates in greater detail the electroslag refining vessel, the cold hearth vessel, and the various apparatus associated with this vessel.

As indicated by FIG. 2, the station 30 is an electroslag refining station disposed in the upper portion 32 of the vessel and the cold hearth station 40 is disposed in the lower portion 42 of the vessel. The vessel is a double walled vessel having an inner wall 82 and an outer wall 84. Between these two walls, a cooling liquid such as water is provided as is conventional practice with some cold hearth apparatus. The cooling water 86 may be flowed to and through the flow channel between the inner wall 82 and outer wall 84 from supply means and through conventional inlet and outlet means which are conventional and which are not illustrated in the figures. The use of cooling water, such as 86, to provide cooling of the walls of the cold hearth station 40 is necessary in order to provide cooling at the inner wall 82 and thereby to cause the skull 44 to form on the inner surface of the cold hearth structure. The cooling water 86 is not essential to the operation of the electroslag refining or to the upper portion of the electroslag refining station 30 but such cooling may be provided to insure that the liquid metal 46 will not make contact with the inner wall 82 of the containment structure because the liquid metal 46 could attack the wall 82 and cause some dissolution therefrom to contaminate the body of liquid metal 46 within the cold hearth station 40.

In FIG. 2, a structural outer wall 88 is also illustrated. Such an outer wall may be made up of a number of flanged tubular sections. Two such sections 90 and 92 are illustrated in the bottom portion of FIG. 2.

Further, U.S. Pat. No. 5,084,091 deals with the use of cold hearth type apparatus in the atomizing of metals.

The cold finger and close coupled atomization structure is not shown in FIG. 2 or in FIG. 1 as the detail is too great to be clearly illustrated. However, the structural detail omitted from FIGS. 1 and 2 is illustrated in and is now described with reference to FIGS. 3 and 4 in which the cold finger and close coupled structure is shown in detail.

Referring now, particularly to FIGS. 3 and 4, the cold finger structure is shown in detail in FIG. 3 in its relation to the processing of the metal from the cold hearth structure and the delivery of liquid melt 46 from the cold hearth station 40 as illustrated in FIGS. 1 and 2. The illustration of FIG. 3 shows the cold finger and close coupled structures with the solid metal skull and with the liquid metal reservoir in place. By contrast, FIG. 4 illustrates the cold finger structure without the close coupled structure, the liquid metal, or solid metal skull in order that more structural details may be provided and clarity of illustration may be gained in this way.

Cold finger structures of a general character are not themselves novel structures but have been described in the literature. The Duriron Company, Inc., of Dayton, Ohio, has published a paper in the *Journal of Metals* in September 1986 entitled "Induction Skull Melting of Titanium and Other Reactive Alloys", by D. J. Chronister, S. W. Scott, D. R. Stickle, D. Eylon, and F. H. Froes. In this paper, an induction melting crucible for reactive alloys is described and discussed. In this sense, it may be said that through the Duriron Company a ceramicless melt system is available as it is from other sources.

As the Duriron Company article acknowledges, their scheme for melting metal is limited by the volume capacity of their segmented melt vessel. Periodic charging of their vessel with stock to be melted is necessary. It has been found that a need exists for continuous streams of molten metal which goes beyond the limited capacity of vessels such as that taught by the Duriron article.

In addition, cold finger apparatus having a bottom pour spout similar to that illustrated in FIGS. 3 and 4 is available from Leybold Technology, Inc. of Enfield, Conn.

A different structure than that disclosed in the Duriron Company article has been devised and this structure is disclosed in U.S. Pat. No. 5,160,532 referenced above. This structure combines a cold hearth with a cold finger orifice so that the cold finger structure effectively forms part, and in the illustration of FIG. 3 the center lower part, of the cold hearth. In making this combination, we have preserved the advantages of the cold hearth mechanism which permits the purified alloy to form a skull by its contact with the cold hearth and thereby to serve as a container for the molten version of the same purified alloy. In addition, we have employed the cold finger orifice structure of station 180 of FIG. 3 to provide a more controllable skull 183 and particularly of a smaller thickness on the inside surface of the cold finger structure. As is evident from FIG. 3, the thicker skull 44 in contact with the cold hearth and the thinner skull 183 in contact with the cold finger structure are essentially continuous.

One reason why the skull 183 is thinner than 44 is that a controlled amount of heat may be put into the skull 183 and into the liquid metal body 46 which is proximate the skull 183 by means of the induction heating coils 185. The induction heating coil 185 is water cooled by flow of a cooling water through the coolant and power supply 187. Induction heating power supplied to the unit 187 from a power source 189 is shown schematically in FIG. 3. One significant advantage of the cold finger construction of the structure of station 180 is that the heating effect of the induction energy penetrates through the cold finger structure and acts on the body of liquid metal 46 as well as on the skull structure 183 to apply heat thereto. This is one of the features of the cold finger structure and it depends on each of the fingers of the structure being insulated from the adjoining fingers by an air or gas gap or by an insulating material. This arrangement is shown in clearer view in FIG. 4 where both the skull and the body of molten metal is omitted from the drawing for clarity of illustration. An individual cold finger 97 in FIG. 4 is separated from the adjoining finger 92 by a gap 94 which gap may be provided with and filled with an insulating material such as a ceramic material or with an insulating gas. The molten metal held within the cold finger structure of station 180 does not leak out of the structure through the gaps such as 94 because the skull 183, as illustrated in FIG. 3, forms a bridge over the various cold fingers and prevents and avoids passage of liquid metal therethrough. As is evident from FIG. 4, all gaps extend down to the bottom of the cold finger structure. This is evident in FIG. 4 as gap 99 aligned with the line of sight of the viewer is shown to extend all the way to the bottom of the cold finger structure of station 180. The actual gaps can be quite small and of the order of 20 to 50 mils so long as they provide good insulating separation of the fingers.

Because it is possible to control the amount of heating and cooling passing from the induction coils 185 to and through the cold finger structure of station 180, it is possible to adjust the amount of heating or cooling which is provided through the cold finger structure both to the skull 183 as well as to the body 46 of molten metal in contact with the skull.

Referring now again to FIG. 4, the individual fingers such as 90 and 92 of the cold finger structure are provided with a cooling fluid such as water by passing water into the receiving pipe 96 from a source not shown, and around through the manifold 98 to the individual cooling tubes such as 100. Water leaving the end of tube 100 flows back between the outside surface of tube 100 and the inside surface of finger 90 to be collected in manifold 102 and to pass out of the cold finger structure through water outlet tube 104. This arrangement of the individual cold finger water supply tubes such as 100 and the individual separated cold fingers such as 90 is essentially the same for all of the fingers of the structure so that the cooling of the structure as a whole is achieved by passing water in through inlet pipe 96 and out through outlet pipe 104

The net result of this action is seen best with reference to FIG. 3 where a stream 156 of molten metal is shown exiting from the cold finger orifice structure. This flow is maintained when a desirable balance is achieved between the input of cooling water and the input of heating electric power to and through the induction heating coils 185 and 135.

The cooling water which enters each finger of the cold finger structure flows in a manner best illustrated and described with reference to FIG. 4 above. A similar flow occurs in the structure illustrated in FIG. 3 although the illustration of FIG. 3 is more schematic than that shown in FIG. 4. For convenience of reference, the inlet pipe 96 and outlet pipe 104 are shown with different orientation than in FIG. 4 for convenience of illustration.

The induction heating coils 85 of FIG. 4 show a single set of coils operating from a single power supply 87 supplied with power from the power source 89. In the structure of FIG. 3 two induction heating coils are employed, the first of which is placed adjacent the tapered portion of the generally funnel shaped cold finger device and supplied heat principally to the controllable skull 183. A power source 189 supplies power to power supply 187 and this power supply furnishes the power to the set of coils 185 positioned immediately beneath the tapered portion of cold finger structure. A second power source 139 furnishes power to power supply 137 and power is supplied from the source 137 to a set of coils 135 which are positioned along the more vertical portion of the cold finger apparatus to permit a control of the flow of molten metal from bath 46 through the vertical portion of the cold finger apparatus.

An increase in the amount of induction heating through coil 135 can cause a remelting of the solidified plug of metal in the vertical portion of the cold finger apparatus and a renewal of stream 156 of molten metal through passageway 130. When the stream 156 is stopped or slowed, there is a corresponding growth and thickness of the skull 128 in the vertical portion of the cold finger apparatus. The regulation of the amount of cooling water flowing through the cold finger apparatus itself as well as the flow of induction heating current through the coils 185 and 135 and particularly the coil 135 regulates the thickness of the thinner skull 128.

As has been noted above when the rate of flow of metal from the cold hearth 40 through the cold finger mechanism 180 is reduced it is necessary to reduce also the flow of the refining current passing through the body of refined metal 46 as well as through the slag 34 and through the electrode 24. Such reduction in refining current has the effect of reducing the rate of melting of the electrode 24 at the upper surface of the slag 34 and in this way reducing the rate at which molten metal accumulates in the cold hearth 40.

When the flow of stream 156 is brought to a stop through the enlargement of the thickness of the skull 128 in the vertical portion of the cold finger apparatus the liquid metal 46 in the cold hearth as well as the liquid salt 34 and the slag station can be kept molten by passing a current through the apparatus in the manner described above but at a sufficiently low level that the reservoir 46 of molten metal remains molten and the slag bath 34 remains molten but the melting of the electrode at the upper surface of the slag bath 34 proceeds at a very low or negligible level so that the level of molten metal in cold hearth station 40 does not build up excessively.

In operation, the apparatus may best be described with reference, now, again to FIG. 1.

One feature is illustratively shown in FIG. 1. This feature concerns the throughput capacity of the apparatus. As is indicated, the ingot 24 of unrefined metal may be processed in a single pass through the electroslag refining and related apparatus and through the cold hearth station 40 to form a continuous stream 156 of refined metal. Very substantial volumes of metal can be processed through the apparatus because the starting ingot 24 has a relatively small concentration of impurities such as oxide, sulfides, and the like, which are to be removed by the electroslag refining process. The stream 156 of FIG. 3 formed by the processing as illustrated in FIGS. 1 and 2 is a stream of refined metal and is free of the oxide, sulfide and other impurities which can be removed by the electroslag refining of station 30 of the apparatus of FIG. 1. It is, of course, possible to process a single relatively large scale ingot through the apparatus and to weld the top of ingot 24 to the bottom of a superposed ingot to extend the processing of ingots through the apparatus of FIG. 1 to several successive ingots. The term ingot as used herein designates one form of electrode which can be processed. Other forms of electrode, such as compacted scrap metal and the like, can also be processed.

Depending on the application to be made of the electroslag refining apparatus as illustrated in FIG. 1, there is established a need to control the rate at which a metal stream such as 156 is removed from the cold finger orifice structure 180.

The rate at which such a stream of molten metal may be drained from the cold hearth through the cold finger structure 180 is controlled by the cross-sectional area of the orifice and by the hydrostatic head of liquid above the orifice. This hydrostatic head is the result of the column of liquid metal and of liquid salt which extends above the orifice of the cold finger structure 180. The flow rate of liquid from the cold finger orifice or nozzle has been determined experimentally for a cylindrical orifice. This relationship is shown in FIG. 5 for two different hydrostatic head heights of liquid metal. The lower plot defined by X's is for a two inch head of molten metal and the upper plot defined by +'s and o's is for a 10 inch head of molten metal. In this figure, the flow rate of metal from the cold finger nozzle is given on the ordinate in pounds per minute. Two abscissa are shown in the figure—the lower is the nozzle area in square millimeters and the upper ordinate is the nozzle diameter in millimeters. Based on the data plotted in this figure, it may be seen that for a nozzle area of 30 square millimeters, the flow rate in pounds per minute was found to be approximately 60 pounds per minute for the 10 inch hydrostatic head. For the 2 inch hydrostatic head, this nozzle area of 30 square millimeters gave the flow rate of approximately 20 pounds per minute.

What is made apparent from this experiment is that if a electroslag refining apparatus, such as that illustrated in FIG. 2, is operated with a given hydrostatic head, that a nozzle area can be selected and provided for the cold finger orifice which permits an essentially constant rate of flow of liquid metal from the refining vessel so long as the hydrostatic head above the nozzle is maintained essentially constant. It can be important in the operation of such an apparatus to establish and maintain an essentially constant hydrostatic head. To provide such a constant hydrostatic head, it is important that the electroslag refining current flowing through the refining vessel be such that the rate of melting of metal from the ingot such as 24 be adjusted to provide a rate of melting of ingot metal which corresponds to the rate of withdrawal of metal in stream 56 from the refining vessel. In this way maintenance of a constant hydrostatic head to within a few inches or more can be achieved.

In other words, one control on the rate at which the metal from ingot 24 is refined in the apparatus of FIG. 1 is determined by the level of refining power supplied to the vessel from a source such as 74 of FIG. 1. Such a current may be adjusted to values between about 2,000 and 20,000 amperes. A primary control, therefore, in adjusting the rate of ingot melting and, accordingly, the rate of introduction of metal into the refining vessel is the level of power supply to the vessel. In general, a steady state is desired in which the rate of metal melted and entering the refining station 30 as a liquid is equal to the rate at which liquid metal is removed as a stream 156 (see FIG. 3) through the cold finger structure. Slight adjustments to increase or decrease the rate of melting of metal are made by adjusting the power delivered to the refining vessel from a power supply such as 74. Also, in order to establish and maintain a steady state of operation of the apparatus, the ingot must be maintained in contact with the upper surface of the body of molten salt 34 and the rate of descent of the ingot into contact with the melt must be adjusted through control means within box 12 to ensure that touching contact of the lower surface of the ingot with the upper surface of the molten slag 34 is maintained.

The deep melt pool 46 within cold hearth station 40, which is described in the background statement above as a problem in the conventional electrorefining processing, is found to be an advantage in the electroslag refining of the subject invention.

Referring now particularly to station 190 of FIG. 3, this station is a close coupled atomization apparatus which is combined and mounted to the Cold finger station 180. The physical contact between the bottom of the cold finger apparatus of station 180 and the top of the close coupled atomization station 190 is at the upper end of melt guide tube 131. Melt guide tube 131 is a ceramic tube which may be made of boron nitride, aluminum oxide or some other high performance ceramic capable of withstanding high temperature thermal shock and withstanding the flow of molten metal therethrough at high temperatures of 1000° C. or more without cracking or otherwise deteriorating. The contact between the upper end of melt guide tube 131 and the lower end of the cold finger apparatus of station 180 is a physical contact provided by conventional clamping means, not shown, and providing a clear and sealed flow path for melt 46 emerging as stream 156 from the station 180 and entering the upper end of melt guide tube 131 as stream 130 within the close coupled atomization station 190. The lower end of melt guide tube 131 is positioned in a generally conforming opening within the housing 215. Gas is supplied to plenum 222 within the housing 215 from a source of gas, not shown, through inlet pipe 230. Inlet pipe 230 is mounted into the outer wall of housing 215 and the entering gas is distributed about the plenum 222 because of its relatively larger size.

In order to accomplish close coupled atomization pursuant to the present invention it is essential that the stream of atomizing gas be directed to impact with the stream of melt at an angle of less than 45 degrees. In general this is accomplished by providing an inwardly tapered outer surface on the lower end of the melt guide tube. The melt emerges from the melt guide tube as a descending stream and the atomizing gas flows down in contact with or very close to the inwardly tapered surface of the melt guide tube. The angle at which the two streams intersect when the atomizing apparatus is in operation and both streams are flowing is an acute angle which generally conforms closely to the acute angle between vertical and the angle at which the external surface of the lower end of the melt guide tube is set. This angle is less than 45 degrees and is preferably less than 30 degrees. Preferred operating results have been obtained when the angle is between 8 and 25 degrees with the smaller angles being preferred. Very satisfactory close coupled atomization results have been obtained when the acute angle is between 11 and 15 degrees.

An adjustable gas orifice 228 of generally annular configuration is formed between the stationary housing element 215 and the moveable housing element 234. Element 234 is in essence a shaped plate which forms the bottom wall of plenum 222 as well as the bottom of the annular gas orifice 228. The element 234 is moveable vertically by virtue of the threaded engagement 236 between the housing 215 and a threaded ring element 240 mounted to the plate 234 by conventional screw means, such as 242.

In operation the melt 46 passes down through cold finger station 180 and emerges at the bottom 218 of melt guide tube 131. As the melt emerges, it is impacted by a gas stream emerging from orifice 228 to form the atomization plume 232.

It will be appreciated that other forms of close coupled atomization apparatus may be employed at station 190. An essential element of the station 190 is a ceramic melt guide tube, such as 131 which delivers melt to an atomization zone immediately below the opening, such as 218 from the lower end of the melt guide tube in combination with a closely coupled gas orifice, such as 228 which can deliver gas to the melt stream immediately as it emerges from the lower end 218 of the melt guide tube. A preferred form of melt guide tube is one which has an inwardly tapered lower end 216 disposed within a generally conforming tapered opening to permit a interaction of atomizing gas and flowing melt stream at an edge formed at an acute angle about between 10 and 25 degrees. Smaller angles are preferred between 10 and 20 degrees and highly desirable results have been obtained with angles of the order of 11 to 15 degrees.

What is claimed is:

1. Apparatus for atomization of refined metal which comprises, electroslag refining apparatus operationally linked to close coupled atomization apparatus, said electroslag refining apparatus comprising, a refining vessel adapted to receive and to hold a refining molten slag, a body of molten slag in said vessel, an electrode of unrefined metal, means for positioning and for maintaining said electrode in said vessel in touching contact with said molten slag, electric supply means adapted to supply refining current to said electrode and through said electrode and molten slag to a body of refined metal beneath said slag to keep said refining slag molten and to melt said electrode where it contacts said slag, means for advancing said electrode toward and into contact with said molten slag at a rate corresponding to the rate at which the contacted surface of said electrode is melted as the refining thereof proceeds, a cold hearth vessel beneath said electroslag refining apparatus, said cold hearth being adapted to receive and to hold electroslag refined molten metal in contact with a solid skull of said refined metal formed on the walls of said cold hearth vessel, a body of refined molten metal in said cold hearth vessel beneath said body of molten slag, a cold finger apparatus below said cold hearth said cold finger apparatus being adapted to receive and to dispense as a stream refined molten metal processed through said electroslag refining process and descending through said cold hearth, said cold finger apparatus having a bottom pour orifice, a skull of solidified refined metal in contact with said cold hearth and said cold finger apparatus including said bottom pour orifice, said operationally linked close coupled atomization apparatus comprising, a ceramic melt guide tube disposed immediately below the bottom pour orifice of said cold finger apparatus and adapted to receive melt from said bottom pour orifice, and a gas orifice closely coupled to the lower end of said melt guide tube.

* * * * *